United States Patent [19]

Papa

[11] Patent Number: 4,613,191

[45] Date of Patent: Sep. 23, 1986

[54] GROUNDING CONNECTOR

[75] Inventor: Ralph A. Papa, Harrisburg, Pa.

[73] Assignee: E. I. Du Pont de Nemours and Company, Wilmington, Del.

[21] Appl. No.: 723,525

[22] Filed: Apr. 15, 1985

[51] Int. Cl.[4] ..... H01R 4/66

[52] U.S. Cl. ..... 339/14 R; 174/78

[58] Field of Search ..... 339/14 R, 14 L, 143 R, 339/103 B; 174/78, 153 G, 65 G

[56] References Cited

U.S. PATENT DOCUMENTS

| | | | |
|---|---|---|---|
| 1,310,054 | 7/1919 | Brown | 174/65 |
| 3,142,721 | 7/1964 | Long | 174/65 |
| 3,568,128 | 3/1971 | Taylor | 339/14 R |
| 4,416,501 | 11/1983 | Fusselman et al. | 339/97 |

FOREIGN PATENT DOCUMENTS

| | | | |
|---|---|---|---|
| 3311651 | 10/1984 | Fed. Rep. of Germany | 339/143 R |

OTHER PUBLICATIONS

Cable Shield Termination, Goplen et al, IBM Tech. Discl. Bull., vol. 18, No. 5, pp. 1566–1567, 10–1975.

*Primary Examiner*—Eugene F. Desmond

[57] ABSTRACT

A grounding connector for a shielded cable. The connector includes a housing which encloses a stripped length of the cable and a conductive element in contact with the shield. Slots in the housing adapt it to fit in a notch on a conductive panel. The element has opposed, projecting, bent arms which contact the notched edge of the panel.

5 Claims, 4 Drawing Figures

GROUNDING CONNECTOR

BACKGROUND

This invention relates generally to electrical connections in electronic equipment and, more particularly, to the grounding of shielded cables coupled to such equipment.

It is, of course, known that a shielded cable can be grounded for the purpose of reducing or eliminating electromagnetic and radio frequency interference (EMI/RFI) in the equipment to which it is coupled. For example, in U.S. Pat. No. 4,416,501, Fusselman et al. disclosed the use of a U-shaped clamp and a ferrule for grounding the conductive shield of a cable to a shroud for a wiring block. The use of inner and outer, flanged tubes to ground the outer conductor of a coaxial cable is disclosed in U.S. Pat. No. 3,142,721 to Long. In both instances, skill, dexterity and time are required to insert the tubular elements properly in a stripped end of a cable and the parts must then be crimped or clamped in place.

SUMMARY

In accordance with the present invention, a shielded cable is provided with a preassembled grounding connector. The cable has a layer of insulation over a conductive shield. In a stripped length of the cable, there is a conductive element in contact with the shield. The element has integral arms projecting through a dielectric housing which encases the stripped length and the housing has opposed slots adapting it to fit in a notch in a conductive panel with the arms in electrical contact with the panel.

DRAWINGS

DESCRIPTION

Figure 1:
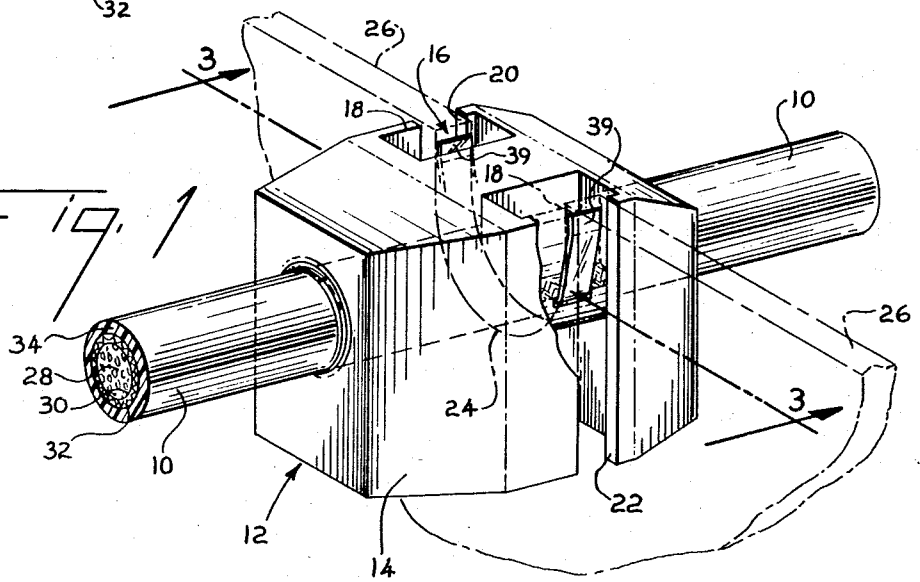
FIG. 1 is a perspective view of the grounding connector of the present invention.

As shown in FIG. 1, a cable 10 passes through a connector 12 which includes a dielectric housing 14 and a grounding contact 16. Housing 14 has a U-shaped channel 18 extending along both sides and around its bottom. Along its sides, housing 14 has slots 20, 22 opening into channel 18. When connector 12 is mounted in a notch 24 on a conductive panel 26, edges of the panel fit closely in and extend through slots 20, 22 into channel 18. Typically, panel 26 is cast from aluminum and is a part of the chassis in a computer.

Cable 10 has a plurality of insulated conductors 28 covered, in turn, by an aluminized layer 30 of polymeric film, a flexible conductive shield 32 and an outer layer 34 of insulation. The inner conductors 28 may be either stranded or single wires and shield 32 is usually a braided screen. Connector 12 can also be used on other shielded cables, e.g., coaxial cables.

Figure 2:
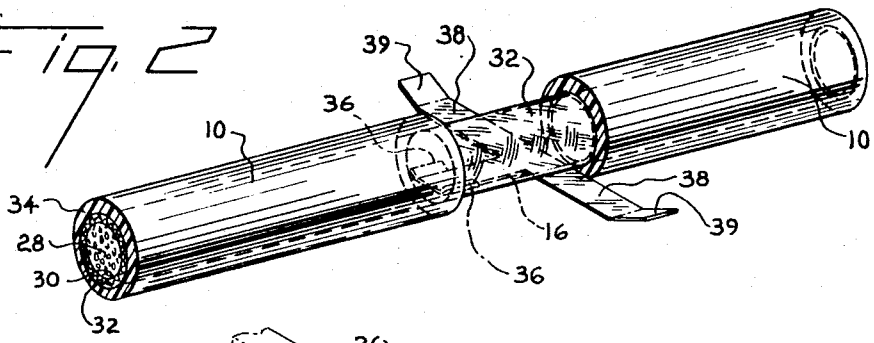
FIG. 2 is a perspective view of the cable and contact shown in FIG. 1.

Referring now to FIG. 2, cable 10 is prepared by stripping outer insulation 34 from an intermediate length to expose shield 32. Then, contact 16 is attached to the exposed shield, as by soldering. At one end, contact 16 has angularly disposed, projecting lips 36 which conform generally to the outline of shield 32. At its other end, contact 16 has opposed, lateral extensions or arms 38. There is an angularly disposed, flat tab 39 at the end of each arm 38. Following attachment of the contact 16, cable 10 is placed in a fixture, arms 38 are bent upwardly and housing 12 is molded thereon from a suitable thermoplastic, e.g., polyvinyl chloride.

Figure 3:
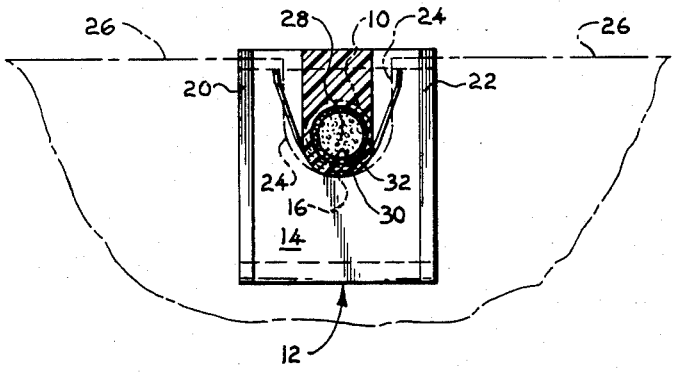
FIG. 3 is a transverse cross section taken on line 3—3 in FIG. 1.
Figure 4:
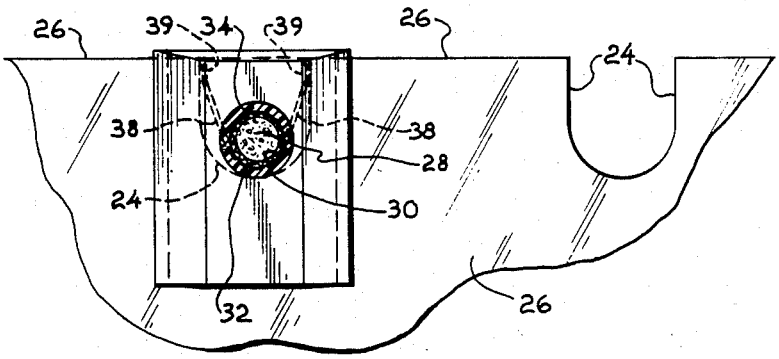
FIG. 4 is a sectional end view of the connector shown in FIGS. 1 and 3.

The manner in which connector 12 slides into place in a notch 24 in the upper edge of panel 26 is shown in FIGS. 1, 3 and 4. Tightness of the fit in slots 20, 22 provides strain relief for cable 10. Contacts 16 are stamped and formed from spring metal stock e.g., beryllium copper or phosphor bronze. During fabrication of the connector, arms 38 are bent inwardly but the spacing of tabs 39 is greater than the width of notches 24 in panel 26, as shown in FIG. 3. Thus, as the connector is mounted in a notch, tabs 39 make a wiping contact, are biased into engagement with the edge of the panel and provide a reliable, low impedance connection to ground, thereby yielding an EMI/RFI shield for components in a computer or other electronic equipment to which cable 10 is coupled.

Another advantage of the connector disclosed herein is that the same sized housing 14, i.e., one mold, can be used for several sizes of cables and contacts. Instead of the soldered attachment of contact 16 to shield 32, a crimped barrel could be provided. These and other advantages and variations will occur to those skilled in the art without departing from the present invention which, accordingly, is intended to be limited only by the scope of the appended claims.

What is claimed as new and desired to be secured by Letters Patent is:

1. A grounding connector for a cable having a layer of insulation over a conductive shield, said connector comprising a conductive element contacting said shield in a stripped length of said cable and a dielectric housing encasing said stripped length, said element having an integral arm projecting therefrom and through said housing for contact with a conductive panel, said housing being a bushing provided with a slot for mounting the connector on an edge of said panel and said arm being bent for yielding contact with said edge.

2. The connector of claim 1 wherein said bushing has dual, opposed slots and said element has dual opposed arms, said dual slots adapting the connector to fit in a notch in said panel with said arms in electrical contact with the panel.

3. The connector of claim 2 wherein said arms terminate in bent tabs adapted to wipe and then bear on the edge of the panel.

4. A cable having a layer of insulation over a conductive shield and a grounding connector thereon, said connector comprising:

a conductive element contacting said shield in an intermediate stripped length of the cable and a dielectric housing on said stripped length, said housing having opposed slots adapting it for mounting in a notch on a conductive panel, said element having an opposed pair of spring arms projecting from said housing in opposite directions, each arm being in line with a slot for yielding contact with a panel on which the connector is mounted.

5. The cable and connector of claim 4 wherein said arms are bent toward each other and terminate inwardly bent tabs.

* * * * *